US010638826B2

(12) United States Patent
Lotti

(10) Patent No.: US 10,638,826 B2
(45) Date of Patent: May 5, 2020

(54) APPLICATOR FOR ARTIFICIAL LASH EXTENSIONS

(71) Applicant: LASHIFY, INC., Los Angeles, CA (US)

(72) Inventor: Sahara Lotti, Los Angeles, CA (US)

(73) Assignee: Lashify, Inc., Los Angeles, CA (US)

( * ) Notice: Subject to any disclaimer, the term of this patent is extended or adjusted under 35 U.S.C. 154(b) by 0 days.

(21) Appl. No.: 15/968,453

(22) Filed: May 1, 2018

(65) Prior Publication Data

US 2018/0242715 A1 Aug. 30, 2018

Related U.S. Application Data

(63) Continuation of application No. PCT/US2017/067513, filed on Dec. 20, 2017.

(Continued)

(51) Int. Cl.

| | |
|---|---|
| ***A41G 5/02*** | (2006.01) |
| ***A45D 44/00*** | (2006.01) |
| ***B25B 9/02*** | (2006.01) |

(52) U.S. Cl.

CPC ..... *A45D 44/00* (2013.01); *A41G 5/02* (2013.01); *B25B 9/02* (2013.01); *A45D 2200/10* (2013.01)

(58) Field of Classification Search

CPC ..... A45D 5/02; A45D 2/48; A45D 2200/10; A45D 44/002; A45D 44/005; A45D 44/12; A41G 5/02; A41G 5/004; A41G 5/006

(Continued)

(56) References Cited

U.S. PATENT DOCUMENTS

| | | | |
|---|---|---|---|
| 1,831,801 | A | 11/1931 | Birk |
| 2,323,595 | A | 7/1943 | Hanisch |

(Continued)

FOREIGN PATENT DOCUMENTS

| | | |
|---|---|---|
| CN | 303086463 | 1/2015 |
| CN | 3040495055 | 2/2017 |

(Continued)

OTHER PUBLICATIONS

Cosmopolitan, You've Been Applying False Eyelashes Wrong Your Whole Life, https://www.cosmopolitan.com/style-beauty/beauty/how-to/a55781/this-false-eyelash-hack-will-change-your-life/, Mar. 25, 2016 (12 pages).

(Continued)

*Primary Examiner* — Chris L. Rodriguez
*Assistant Examiner* — Brianne E Kalach
(74) *Attorney, Agent, or Firm* — Foley & Lardner LLP

(57) ABSTRACT

Cases can be used to house sets of artificial lashes in a specified arrangement. For example, lash fusions may be placed within multiple predefined indentations in the shape of an eyelid. Applicators can be used to resiliently grasp all of the lash fusions in a set of lash extensions, and then simultaneously apply the entire set of lash extensions directly to the underside of the natural lashes. An applicator includes opposed arms that are connected to one another at an inner end designed to be gripped by an individual. The applicator can also include an outer end having a concave shape that is contoured to be substantially flush with the convex shape of the lash line and the predefined indentations of a case that includes the set of lash extensions.

7 Claims, 13 Drawing Sheets

Related U.S. Application Data

(60) Provisional application No. 62/436,585, filed on Dec. 20, 2016.

(58) Field of Classification Search
USPC ..... 132/53, 201; 428/359, 364, 397, 399
See application file for complete search history.

(56) References Cited

U.S. PATENT DOCUMENTS

D154,227 S 6/1949 Alvizua
2,618,279 A 11/1952 Reiffert
3,557,653 A 1/1971 Kim
3,561,454 A * 2/1971 O'Connell ..... A41G 5/02 132/216
3,625,229 A 12/1971 Silson
3,670,742 A 6/1972 Weaner
3,645,281 A 9/1972 Seidler
3,900,038 A 8/1975 Masters
D240,769 S 7/1976 Bowman
4,203,518 A 5/1980 Current
4,697,856 A 10/1987 Abraham
D301,371 S 5/1989 Kaprelian
5,033,626 A 7/1991 Platti
D328,246 S 7/1992 Nottingham et al.
5,322,166 A 6/1994 Crowther
D358,312 S 5/1995 Keenan
D379,923 S 6/1997 De Baschmakoff
D387,483 S 12/1997 Sloan
D403,922 S 1/1999 Terraccino
D404,531 S 1/1999 Bakic et al.
5,896,996 A 4/1999 Chuang
D418,253 S 12/1999 Bakic
D443,471 S 6/2001 Lillelund et al.
6,174,321 B1 6/2001 Webb
6,265,010 B1 7/2001 Franco
D448,927 S 10/2001 Vazquez
D454,981 S 3/2002 Lamagna et al.
D456,077 S 4/2002 Etter et al.
D458,413 S 6/2002 Boilen
D463,280 S 9/2002 Brozell
6,471,515 B2 10/2002 Feuer
D472,675 S 4/2003 Lamagna
D472,810 S 4/2003 Gelardi
D473,106 S 4/2003 Scherer
D475,616 S 6/2003 Lambrecht
D479,365 S 9/2003 Todeschini
D481,946 S 11/2003 Nicholson
D481,952 S 11/2003 Orsomando
D483,232 S 12/2003 Liu
D483,909 S 12/2003 Todeschini
D495,834 S 9/2004 Todeschini
D506,573 S 6/2005 de Grandcourt
D507,678 S 7/2005 Lamagna
D512,913 S 12/2005 Gauthier
6,981,814 B2 1/2006 Geardino et al.
D516,247 S 2/2006 Merheje
D522,376 S 6/2006 Hales
D532,891 S 11/2006 Buthier et al.
D533,650 S 12/2006 Ohta
D534,426 S 1/2007 Bakic
D537,208 S 2/2007 Shaljian
D543,662 S 5/2007 Bivona et al.
D543,815 S 6/2007 Metcalf
7,228,863 B2 6/2007 Dumler
D546,002 S 7/2007 Bowen
D561,045 S 2/2008 Lee
D561,942 S 2/2008 Khubani
D569,041 S 5/2008 Azoulay
D569,553 S 5/2008 Cho
D573,308 S 7/2008 Wittke-Kothe
D575,904 S 8/2008 Iqbal
D584,449 S 1/2009 Shaljian
D588,746 S 3/2009 Ross
D591,599 S 5/2009 Okin et al.
D592,923 S 5/2009 Konopka
D595,054 S 6/2009 Whitaker
D602,354 S 10/2009 Dibnah et al.
D604,579 S 11/2009 Robinson et al.
D607,332 S 1/2010 Huntington et al.
7,748,391 B2 7/2010 Vance
D627,103 S 11/2010 Cho
D638,733 S 5/2011 Sullivan
D639,196 S 6/2011 Sullivan
D640,005 S 6/2011 Lee et al.
D647,799 S 11/2011 Dunwoody
D650,669 S 12/2011 Dunwoody
D650,670 S 12/2011 Dunwoody
D651,082 S 12/2011 Dunwoody
D657,496 S 4/2012 Flatt
D661,599 S 6/2012 Floyd et al.
D669,223 S 10/2012 Lee
D673,325 S 12/2012 Martines
D690,419 S 9/2013 Porat
8,596,284 B2 * 12/2013 Byrne ..... A41G 5/02 132/201
D698,078 S 1/2014 Purizhansky et al.
D700,799 S 3/2014 Ludeman et al.
D707,556 S 6/2014 Kawamura
D714,494 S 9/2014 Vasquez et al.
D716,498 S 10/2014 Wolff
8,939,159 B2 1/2015 Yeo et al.
9,004,299 B2 4/2015 Hardin
9,215,901 B1 12/2015 Schroeder
D753,881 S 4/2016 Hussain et al.
9,314,085 B2 4/2016 Hatch
D755,577 S 5/2016 Segal
9,351,752 B2 5/2016 Slavin
D762,433 S 8/2016 Yang
D764,688 S 8/2016 Robinson et al.
D775,270 S 12/2016 Moffat
D783,899 S 4/2017 Roh
D783,901 S * 4/2017 Kim ..... D24/143
D784,615 S 4/2017 Choi
D796,582 S 9/2017 Beard
D800,966 S 10/2017 Silva
D810,534 S 2/2018 Liu
D814,107 S 3/2018 Lotti et al.
D817,132 S 5/2018 Yang
9,993,373 B2 6/2018 Nassif et al.
D823,538 S 7/2018 Ruggaber
D823,683 S 7/2018 Caldwell
D825,333 S 8/2018 Ozamiz et al.
D829,381 S 9/2018 Kim
D830,170 S 10/2018 Holmes
D832,701 S 11/2018 Oates
D836,432 S 12/2018 Riedel et al.
2002/0094507 A1 7/2002 Feuer
2003/0111467 A1 6/2003 Norman
2005/0061341 A1 3/2005 Choe
2005/0166939 A1 8/2005 Stroud
2007/0050207 A1 3/2007 Merszei
2007/0227550 A1 * 10/2007 Merszei ..... A41G 5/02 132/53
2009/0028625 A1 1/2009 Bonneyrat
2009/0217939 A1 9/2009 Rabe et al.
2009/0223534 A1 9/2009 Green
2009/0266376 A1 * 10/2009 Beschta ..... A41G 5/02 132/201
2010/0170526 A1 7/2010 Nguyen
2011/0121592 A1 5/2011 Cho
2011/0278869 A1 11/2011 Lee et al.
2011/0290271 A1 12/2011 Rabe
2013/0110032 A1 5/2013 Luzon
2013/0255706 A1 10/2013 Dinh
2015/0136162 A1 5/2015 Brouillet et al.
2015/0173442 A1 6/2015 Raouf
2015/0216246 A1 * 8/2015 Ahn ..... A41G 5/02 132/53
2016/0037848 A1 * 2/2016 Lee ..... A41G 5/02 132/201
2017/0112264 A1 4/2017 Park
2017/0358245 A1 12/2017 Dana
2018/0065779 A1 3/2018 Chiba

(56) References Cited

U.S. PATENT DOCUMENTS

| | | | |
|---|---|---|---|
| 2018/0160755 | A1 | 6/2018 | Hansen et al. |
| 2018/0242715 | A1 | 8/2018 | Lotti |
| 2019/0133227 | A1 | 5/2019 | Le |

FOREIGN PATENT DOCUMENTS

| | | |
|---|---|---|
| CN | 3040495065 | 2/2017 |
| CN | 3043100425 | 10/2017 |
| CN | 3043293745 | 10/2017 |
| CN | 3043293755 | 10/2017 |
| CN | 3043821515 | 12/2017 |
| CN | 3044973725 | 2/2018 |
| CN | 3047777375 | 8/2018 |
| CN | 3048598635 | 10/2018 |
| CN | 3048598645 | 10/2018 |
| EP | 1839526 | 7/2009 |
| GB | 1021063 | 2/1966 |
| JP | 2011-177395 | 9/2011 |
| KR | 20090010717 U | 10/2009 |
| KR | 101509029 | 4/2015 |
| WO | WO 2018/022914 | 1/2018 |

OTHER PUBLICATIONS

Delicate Hummingbird, Ha! I've mastered the false lashes!, http://delicatehummingbird.blogspot.com/2011/11/ha-ive-mastered-false-lashes.html, Nov. 10, 2011 (12 pages).

Image Essentials, How to wear false eyelashes without looking like you're wearing them, https://imagessentials.wordpress.com/2012/03/30/how-to-wear-false-eyelashes-without-looking-like-youre-wearing-any/, Mar. 30, 2012 (5 pages).

Amazon, Ocamo False Eyelashes Curler Stainless Steel Extension Eye Lash Applicator Remover Tweezers Clip Makeup Tools, https://www.amazon.kin/Ocamo-Eyelashes-Stanless-Extension-Applicator/dp/B07FT5XW8C?tag=googinhydr18418-21&tag=googinkenshoo-21&ascsu. . ., downloaded from internet Oct. 10, 2018 (3 pages).

Born Pretty, False Eyelashes Thick Natural Simulation Recyclable Curly False Eyelash Makeup Cosmetic Tools, http://www.bornprettystore.com/false-eyelashes-thick-natural-simulation-recyclable-curly-false-eyelash-makeup-cosmetic-tools-p-44675.htmldownloaded from internet Oct. 18, 2018 (6 pages).

Buy Korea, Plastic, False Eyelash Applicator, Multy colour, http://www.buykorea.or.kr/product-details/Plastic-False-Eyelash-Applicator-Multy-colour--3106709.html, downloaded from internet Feb. 14, 2019 (3 pages).

Dream Lashes Curved Volume Tweezer—3 Minute Test, https://www.youtube.com/watch?v=vwgYeE0SD7s, downloaded from the internet Feb. 13, 2019 (1 page).

International Search Report and Written Opinion dated Mar. 12, 2018 in related PCT/2017/067513 filed Dec. 20, 2017 (10 pages).

International Search Report and Written Opinion dated Nov. 27, 2017 in related PCT/US2017/044217 filed Jul. 27, 2017 (10 pages).

Lashify Gossamer Lash Cartridge https://lashify.com/collections/shop-1/products/gossamer-eye-lozenge-c-style?variant=783670738950, downloaded from internet Jun. 15, 2018 (2 pages).

MAC Cosmetics, 34 Lash, http://www.bornprettystore.com/false-eyelashes-thick-natural-simulation-recyclable-curly-false-eyelash-makeup-cosmetic-tools-p-44675.html, downloaded from internet Feb. 14, 2019 (1 page).

Made in China, New Product Eyelashes Aid Eyelashes Applicator Innovative Eyelashes Curler, 2018, https://www.made-in-china.com/productdirectory.do?word=creative+eyelashe+curier&subaction=hunt&style=b&mode=and&code=0&comProvince=nolimit&order=0&isOpenCorrection=1 , downloaded from internet Feb. 13, 2019 (2 pages).

Peonies and Lilies, Bourjois 2 in 1 Tweezers and Faux & Fabulous Eyelashes, posted Oct. 24, 2012 (2 pages).

Buzludzha Monument, Gueorguy Stoilov circa 1980, justanotherbackpacker.com, published by blogger Rich on Apr. 29, 2014 © 2019, online, site visited Aug. 27, 2019. Downloaded from Internet, URL: http://www.justanotherbackpacker.com/buzludzha-monument-bulgaria-ufo/ (Year: 2014)

Cruiser Portable Speaker, NYNE, published at thegamerwithkids.com, posted by Sam Versionone on Apr. 6, 2015 © not listed, https://thegamerwithkids.com/2015/04/06/nyne-cruiser-review-a-wireless-speaker-for-your-bicycle/, downloaded from internet Jun. 20, 2018.

Electron Microscopy Sciences, EMS High Precisions and Ultra Fine Tweezers, https://www.emsdiasum.com/microscopy/products/tweezers/ultra_fine.aspx, downloaded from the internet Feb. 13, 2019 (7 pages).

Focallure, https://shopfocallure.com/collections/eyelashes/products/eyelash-tweezer-by-focallure, downloaded from internet Feb. 14, 2019 (1 page).

Hongjun web page, https://detail.1668.com/offer/574685154983.html?spm=a2615.7691456.newlist.75.22f96dc5Msy00t, downloaded from internet Oct. 31, 2018 (16 pages).

International Search Report and Written Opinion dated Dec. 19, 2019 in related PCT/2019/057104 filed Oct. 19, 2019 (8 pages).

International Search Report and Written Opinion dated Dec. 23, 2019 in related PCT/2019/057102 filed Oct. 19, 2019 (8 pages).

Japonesque False Lash Applicator, https://japonesque.com/products/implements/false-lash-applicator/, downloaded from internet Feb. 13, 2019 (6 pages).

Lashify Wand, https://www.instagram.com/p/BWgeQ8wg00S/?igshid=zaulyw8a6v5, downloaded from internet 2019 (1 page).

Madame Madeline Lashes, Ardell Dual Lash Applicator, https://www.madamemadeline.com/online_shoppe/proddetail.asp?prod=mm62059, downloaded from internet Oct. 18, 201 (3 pages).

Pak Lajpall, Nail Artist Tweezers PL-1, http://www.lajpall.com/proddetail.php?prod=nail-artist-tweezers_1, downloaded from internet Feb. 13, 2019 (1 page).

* cited by examiner

APPLICATOR FOR ARTIFICIAL LASH EXTENSIONS

CROSS-REFERENCE TO RELATED APPLICATIONS

This application is a continuation of International Application No. PCT/US17/67513, filed on Dec. 20, 2017, which claims priority to U.S. Provisional Application No. 62/436,585, filed on Dec. 20, 2016. The contents of the above applications are incorporated herein by reference in their entirety.

FIELD OF THE INVENTION

Various embodiments concern cases for housing artificial eyelashes and applicators for applying artificial eyelashes to the underside of an individual's natural eyelashes.

BACKGROUND

Eyelash extensions have conventionally been used to enhance the length, thickness, and fullness of natural eyelashes. Eyelash extensions, however, must be applied to an individual's natural eyelashes one by one to avoid having the eyelash extensions stick together. Consequently, lash extension services can cost hundreds of dollars depending on the type and number of lashes used, the skill of the cosmetician, and the venue where the eyelash extensions are applied. It usually takes an experienced cosmetician one to two hours to attach a full set of eyelash extensions.

Clusters of artificial lashes have conventionally been used to enhance the length, thickness, and fullness of an individual's natural eyelashes. However, each cluster must be applied to the individual's eyelashes individually in order to avoid having the clusters of artificial lashes stick together and to ensure multiple clusters are evenly distributed across the width of the individual's lash line.

Alternatively, false eyelashes may be applied directly to an individual's eyelid. False eyelashes come in strips (and thus may also be referred to as "strip lashes") that can be trimmed to fit the width of the individual's eyelid. While a strip of false eyelashes can be applied in a single motion, false eyelashes are easily distinguishable from the individual's natural eyelashes and may be uncomfortable when worn for extended periods of time.

BRIEF DESCRIPTION OF THE DRAWINGS

Various embodiments are illustrated by way of example and not limitation in the accompanying drawings, in which like references indicate similar elements. Various objects, features, and characteristics of the present invention will become more apparent to those skilled in the art from a study of the Detailed Description in conjunction with the drawings.

Figure 1:
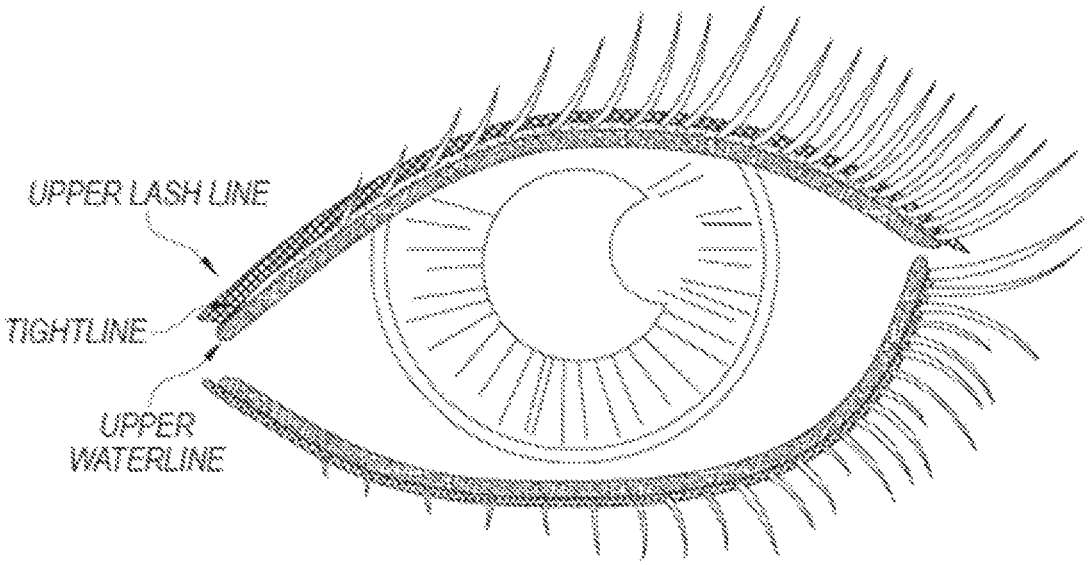
FIG. 1 depicts the upper tightline, upper lash line, and upper waterline of an eyelid.

The figures depict various embodiments for the purpose of illustration only. Those skilled in the art will readily recognize that alternative embodiments may be employed without departing from the principles of the present invention. The claimed subject matter is intended to cover all modifications, equivalents, and alternatives falling within the scope of the present invention as defined by the appended claims.

DETAILED DESCRIPTION

Conventional eyelash extensions (or simply "lash extensions") are individually adhered to an individual's natural eyelashes one-by-one in order to prevent the eyelash extensions from sticking together. However, because the average individual might have anywhere from thirty to eighty natural lashes per eye, the application process can take several hours to attach a full set of lash extensions.

Introduced here are cases for housing sets of artificial lash extensions that can be applied to an individual's natural lashes. Each set of artificial lash extensions can include multiple lash fusions, and each lash fusion can include multiple clusters of artificial lashes. These clusters include multiple artificial hairs made of natural materials (e.g., silk or authentic mink hair) or synthetic materials (e.g., acrylic resin, polybutylene terephthalate (PBT), or synthetic mink hair made of polyester). A cluster of artificial lashes generally includes approximately 10 to 30 artificial hairs (and preferably 10 to 20 artificial hairs). While certain embodiments have been described in the context of lash fusions that include multiple clusters, those skilled in the art will recognize that a lash fusion could also include a series of individual artificial hairs that are connected to one another.

Multiple clusters of artificial lashes are often formed into bundles called "lash fusions." The base of a lash fusion (e.g., where multiple clusters are fused together) is intended to be affixed to an individual's natural lashes. A lash fusion may be approximately 4-8 millimeters (mm) wide. A lash fusion could also include 3-10, 3-7, 5-10, 5-7, or 4-6 clusters. Accordingly, a lash fusion could include 30-150, 30-120, or 30-90 individual artificial hairs. A set of artificial lash extensions can then be formed by positioning multiple lash fusions next to one another in an arrangement that substantially matches the curvature of the upper tightline along the base of the eyelid.

While the multiple lash fusions included in a set of artificial lash extensions are typically not connected to one another (e.g., are not fused together using heat, an adhesive, etc.), the entire set of artificial lash extension can be applied to the underside of the individual's natural lashes in a single motion by an applicator. Thus, the multiple lash fusions in a set of artificial lash extensions may be arranged to match the curvature of an eyelid, as well as an applicator designed to facilitate fixation of the entire set of artificial lash extensions to an individual's natural lashes. A set of artificial lash extensions could include 3-8, 3-5, 5-8, or 4-6 lash fusions. Accordingly, a set of artificial lash extensions could include 150-360 individual artificial hairs.

Also introduced here are applicators for resiliently grasping the multiple lash fusions in a set of artificial lash extensions, and then simultaneously applying the multiple lash fusions along the upper tightline in a single motion. As shown in FIG. 1, the upper tightline is interposed between the upper lash line and the upper waterline. An applicator includes opposed arms that are connected to one another at an inner end (also referred to as the "proximal end") that is gripped by an individual. The applicator can also include an outer end (also referred to as the "distant end" or the "distal end") having a concave (e.g., crescent) shape that is contoured to be substantially flush with the convex shape of the upper tightline. The concave shape of the applicator may also substantially complement the predefined indentations within cases that are responsible for holding sets of artificial lash extensions. Applicators are often comprised of metal (e.g., stainless steel, hardened steel, or titanium) to increase the durability and grasping precision of the opposed arms.

An adhesive may be applied to the top of each lash fusion in a set of artificial lash extensions during the manufacturing process, which enables an individual to easily apply the set of artificial lash extensions directly to the underside of the natural lashes rather than to the eyelid. Additionally or alternatively, the individual could apply an adhesive before applying the set of artificial lash extensions to the underside of the natural lashes. For example, the individual may apply an adhesive to each lash fusion before applying the set of artificial lash extensions to the natural lashes. As another example, the individual may apply an adhesive directly to the natural lashes. Thus, the adhesive could be a waterproof glue or mascara.

Terminology

Brief definitions of terms, abbreviations, and phrases used throughout this application are given below.

Reference to "one embodiment" or "an embodiment" means that a particular feature, structure, or characteristic described in connection with the embodiment is included in at least one embodiment of the disclosure. The appearances of the phrase "in some embodiments" are not necessarily referring to the same embodiment, nor are they necessarily referring to separate or alternative embodiments that are mutually exclusive of one another.

The terms "connected," "coupled," or any variant thereof includes any connection or coupling between two or more elements, either direct or indirect. The coupling or connection between the elements can be physical, logical, or a combination thereof. For example, two components may be coupled directly to one another or via one or more intermediary channels/components. The words "associate with," meanwhile, mean connecting or relating objects, items, etc.

System Topology Overview

Figure 2:
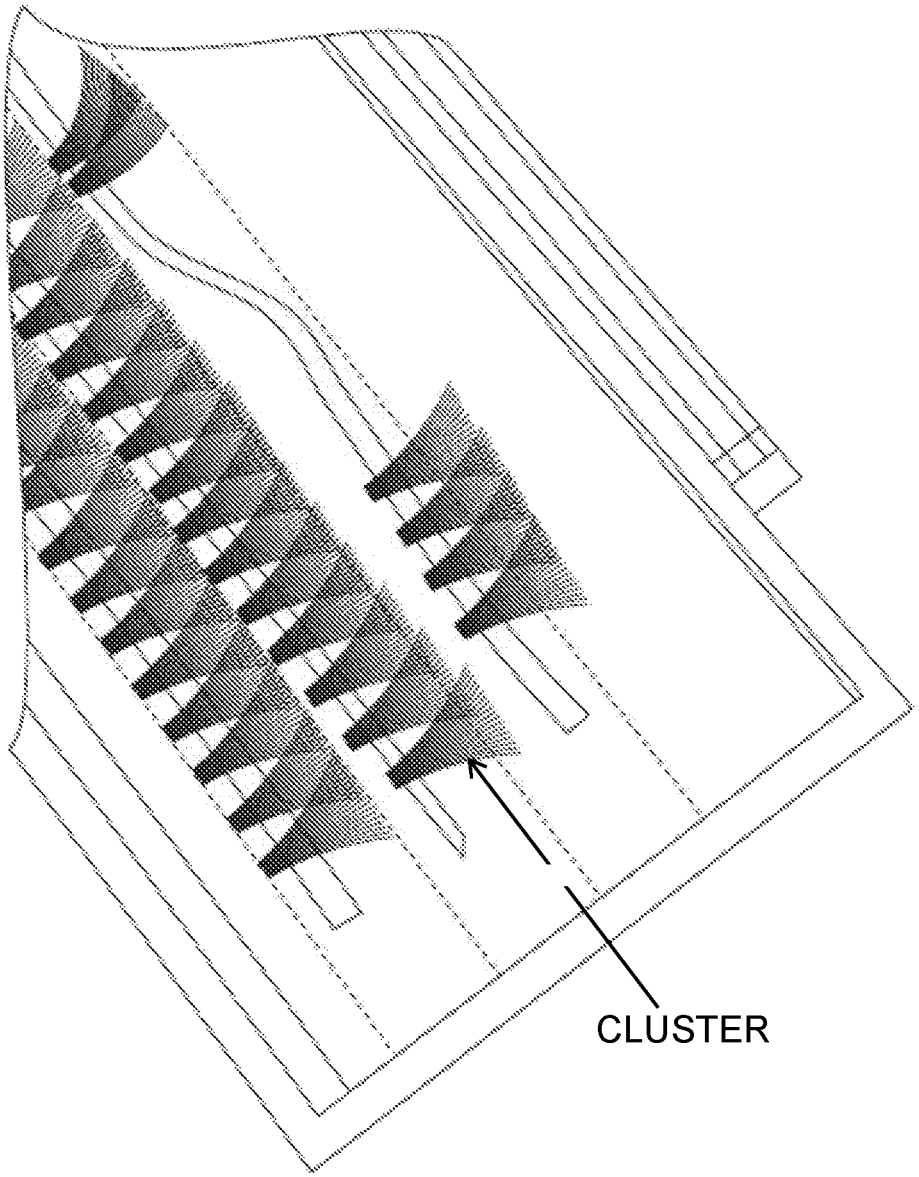
FIG. 2 depicts clusters of artificial lashes that can be used by professional lash technicians and cosmeticians.

FIG. 2 depicts clusters of artificial lashes that can be used by professional lash technicians and cosmeticians. Each cluster of artificial lashes includes multiple artificial hairs that consist of natural materials (e.g., silk or authentic mink hair) or synthetic materials (e.g., acrylic resin, PBT, or synthetic mink hair made of polyester).

Clusters of artificial lashes typically include 10 to 30 artificial hairs that are heated (e.g., as part of a holt melt process) and then secured to one another. For example, in some embodiments linear artificial hairs are heated at one end such that they begin to fuse to one another at that end, while in other embodiments linear artificial hairs are heated near a central point and folded underneath one another.

In some embodiments, some or all of the artificial hairs in a cluster may be tied to a support thread (i.e., knotted). The artificial hairs may be tied by any such means, such as a slip know that prevents horizontal spreading of the cluster.

Figure 3A:
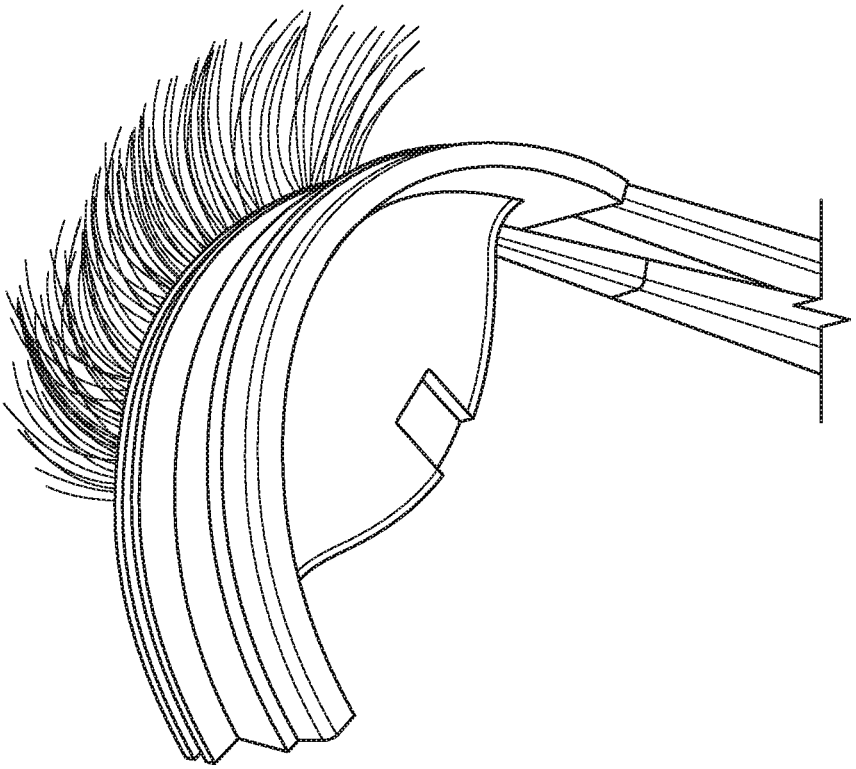
FIGS. 3A-B depict how a set of artificial lash extensions can be affixed beneath the individual's natural lashes.
Figure 3B:
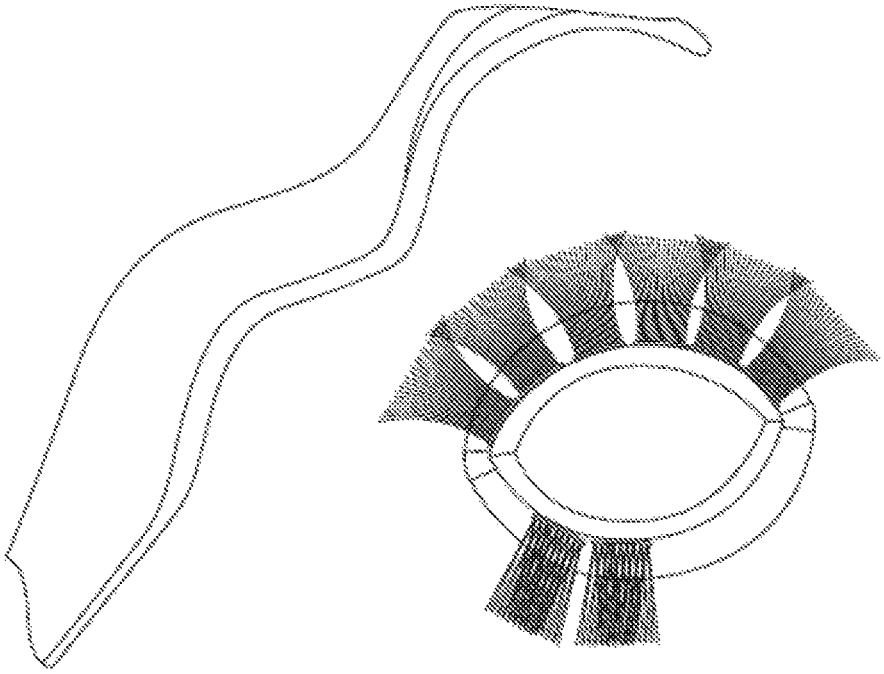

FIGS. 3A-B depict how a set of artificial lash extensions can be affixed to the underside of an individual's natural lashes. More specifically, FIG. 3A is a perspective view of a set of artificial lash extensions from above, while FIG. 2B is a view of the set of artificial lash extensions from below.

A set of artificial lash extensions can include multiple lash fusions that are arranged to match the curvature of the upper tightline of an eyelid. For example, multiple lash fusions may be arranged such that the inner ends (i.e., the bases) form a concave shape that substantially complements the universal tightline of nearly any human eye. In some embodiments, sets of artificial lash extensions preferably include 5-7 distinct clusters of artificial lashes. The number of lash fusions in each set (as well as the number of clusters in each lash fusion) may be based on the thickness of the artificial hair used, the desired style of the eyelid on which the set is intended to be affixed, the desired lash density (also referred to as the "fullness" of the individual's lashes), etc. As shown in FIG. 3B, the set of artificial lash extensions is aligned with the tightline rather than the lash line, and then affixed to the underside of the natural lashes. Said another way, the set of artificial lash extensions is applied directly to the underside of the natural lashes rather than to the eyelid.

An adhesive can be applied to the top of each lash fusion in the set of artificial lash extensions, which enables an individual to easily apply the entire set directly to the natural lashes. The individual responsible for applying the set of artificial lash extensions could be a person who affixes the multiple lash fusions to herself or some other person (e.g., a professional lash technician or a cosmetician). In some embodiments, the adhesive is applied when each lash fusion and/or the set of artificial lash extensions are initially manufactured. Additionally or alternatively, the individual could apply an adhesive before attaching the set of artificial lash extensions to the natural lashes.

The adhesive could be a waterproof (semi-permanent) glue, mascara, or some other co-polymer solution having an adhesive quality. Although latex-based adhesives are generally avoided to avoid irritation of the individual's eyelid (e.g., due to an allergic reaction), adhesives can include various other natural and/or chemical ingredients. Examples of possible adhesives include:

- Arcrylates/ethylhexyl acrylate copolymer, aqua, propylene glycol, ceteareth-25, hydrogenated castor oil, glycerin, phenoxyethanol, 2-bromo-2-nitropropane-1,3-diol, methylcholoroisothiazolinone, methylisothiazolinone, methylparaben, and optionally a color agent (e.g., black 2 (Cl 77266));
- Polyterpene, styrene/isoprene copolymer, petrolatum, polyisobutene, microcrystalline wax (cera microcristalina, cire microcrystalline), hydrogenated styrene/methyl styrene/indene copolymer, styrene/VA copolymer, and optionally an antioxidant (e.g., butylated hydroxytoluene (BHT));
- Chlorine dioxide, p-anisic acid, biotin, lavandula angustifolio oil, propylene glycol, water, 2-ethylhexyl acrylate, and optionally a preservative (e.g., benzalkonium chloride); and
- Acrylate copolymer and water.

Those skilled in the art will recognize that many other adhesive compositions are possible and, in fact, may be desirable for individuals having certain allergies, desiring certain fixation duration (also referred to as "permanency" of the lash extensions), etc.

Semi-permanent clusters of lash extensions may be applied with a Federal Drug Administration-approved (FDA-approved) adhesive that achieves a strong bond. Such adhesives generally include cyanoacrylate. Different types of cyanoacrylates (e.g., ethyl, methyl, propyl, butyl, and octyl) have been designed for bonding to different surfaces. For example, adhesives made from methyl-2-cyanoacrylateare are designed to bond a smooth surface (e.g., the lash extension) to a porous surface (e.g., the natural eyelash), but not on the skin as it may cause irritation.

Figure 4A:
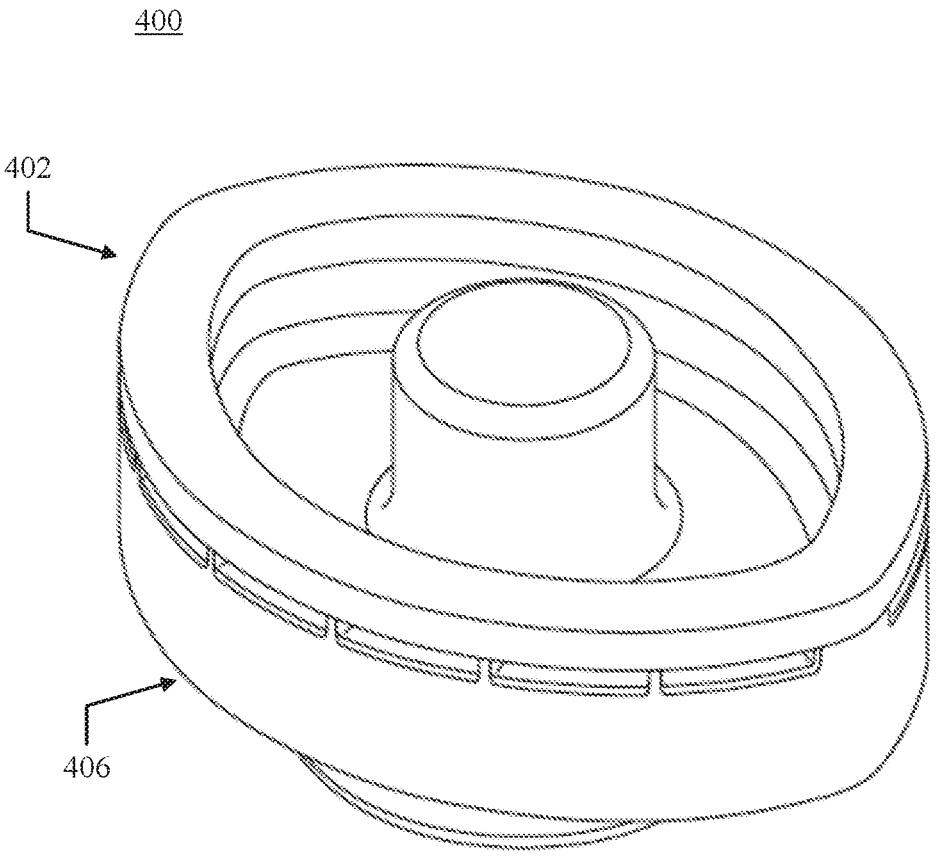
FIGS. 4A-C depict several different views of a case for holding a set of artificial lash extensions.
Figure 4B:
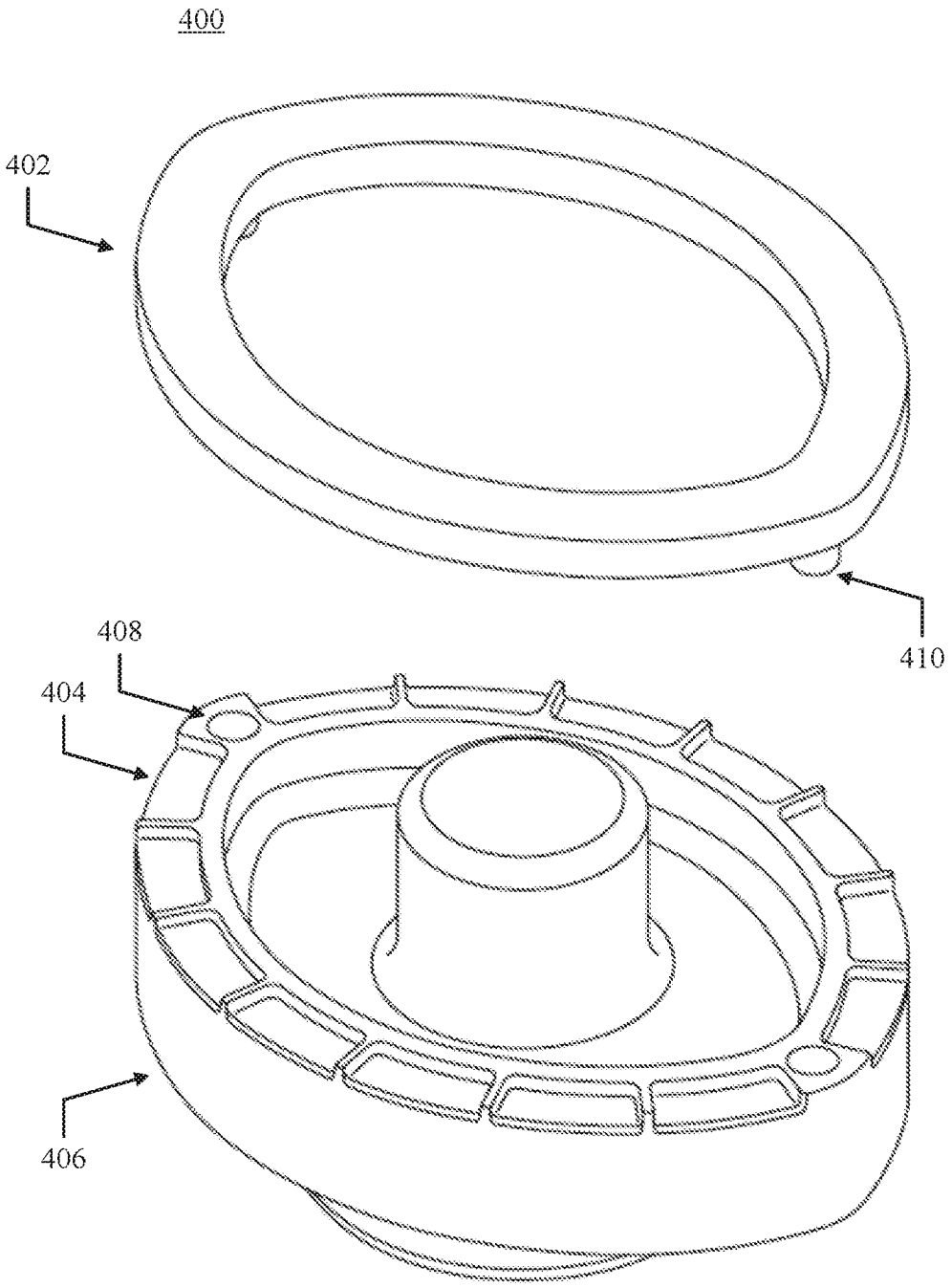
Figure 4C:
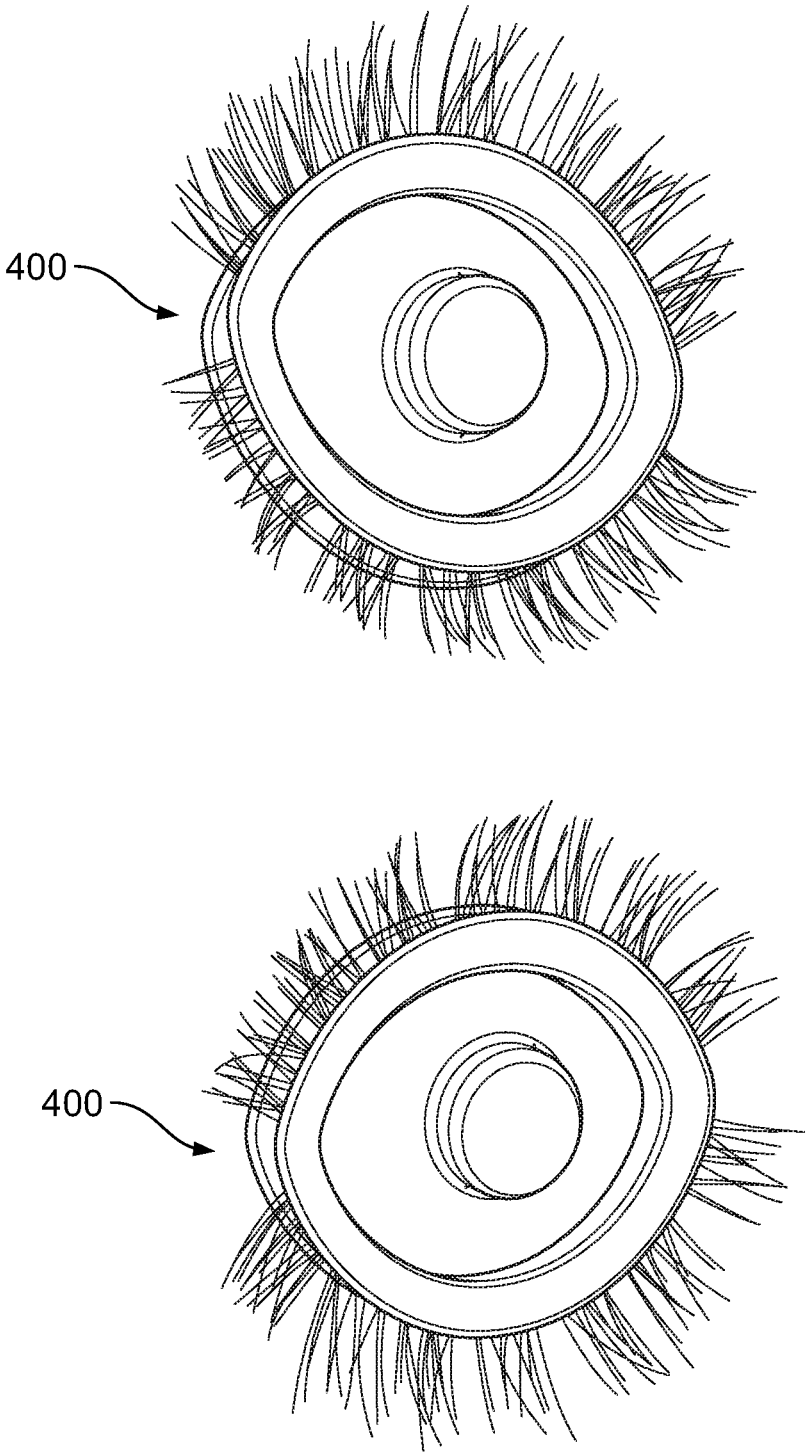

FIGS. 4A-C depict several different views of a case 400 for holding artificial lash extensions. FIG. 4A is a perspective view of the case 400, while FIG. 4B is an exploded view of the case 400 in which the upper cover 402 has been removed to expose multiple predefined indentations 404 within a base assembly 406.

The case 400 may include a base assembly 406 and an upper cover 402 that partially or entirely shields the predefined indentations 404. In some embodiments, the base assembly 406 includes one or more fastener holes 408 that allow fasteners to be used to attach the upper cover 402 to the base assembly 406. One example of a fastener is a fastener boss 410. Other embodiments may provide other means of attachment, such as hidden snaps, latches, detents, ridges, magnets, etc.

The base assembly 406 and/or the upper cover 402 may be partially or entirely composed of metal, plastic, or some other material (e.g., foam). For example, in some embodiments the base assembly 406 includes a die case metal body (e.g., for strength and durability) having a smooth powder coating (e.g., for aesthetics and improved cleanability), while in other embodiments the base assembly 406 includes a recyclable (i.e., disposable) plastic body that is not intended for significant durations of use (e.g., months or years). Those skilled in the art will recognize that any suitable material may be used. For example, in some embodiments plastic may be desirable because it is recyclable and resistant to the adhesives typically applied to lash fusions before fixation to an individual's natural lashes.

Moreover, the outer surfaces of the base assembly 406 and/or the upper cover 402 may be substantially smooth and continuous. Thus, the outer surfaces of these components may be substantially free of any gaps, ridges, or fasteners that would make cleaning difficult or that may inadvertently capture artificial lashes.

FIG. 4C illustrates how multiple lash fusions in a set of artificial lash extensions can be positioned within the case 400 in a specified arrangement. While the multiple lash fusions in the set of artificial lash extensions will typically not be connected to one another, the multiple lash fusions can be arranged such that the set as a whole substantially complements the shape of an eyelid. More specifically, the curvature of the multiple lash fusions may substantially match the tightline curvature of an average person. Thus, an entire set of artificial lash extensions may become substantially flush with the lash line when the set is arranged proximate to the tightline.

The predefined indentations 404 allow the lash fusions to be positioned in a specific arrangement. For example, the curvature of the outer surface of the case 400 may cause the lash fusions to be arranged in the shape of an eyelid (i.e., the outer surface of the case 400 may mimic the natural lash line). Together, the multiple lash fusions form a set of artificial lash extensions that can be collectively applied in a single motion.

Figure 5A:
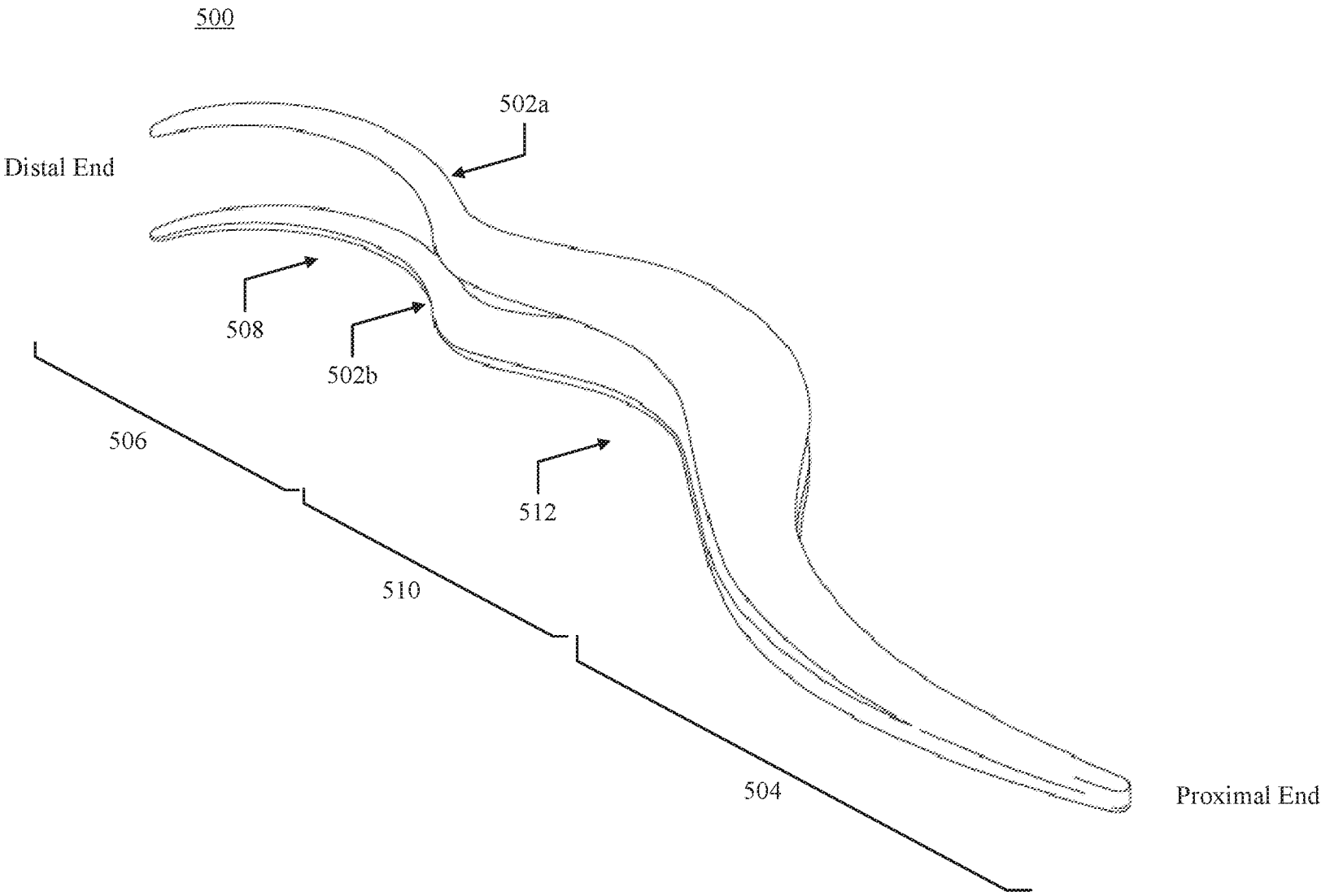
FIGS. 5A-B depict an applicator that can be used to simultaneously apply an entire set of artificial lash extensions to an individual's natural lashes.
Figure 5B:
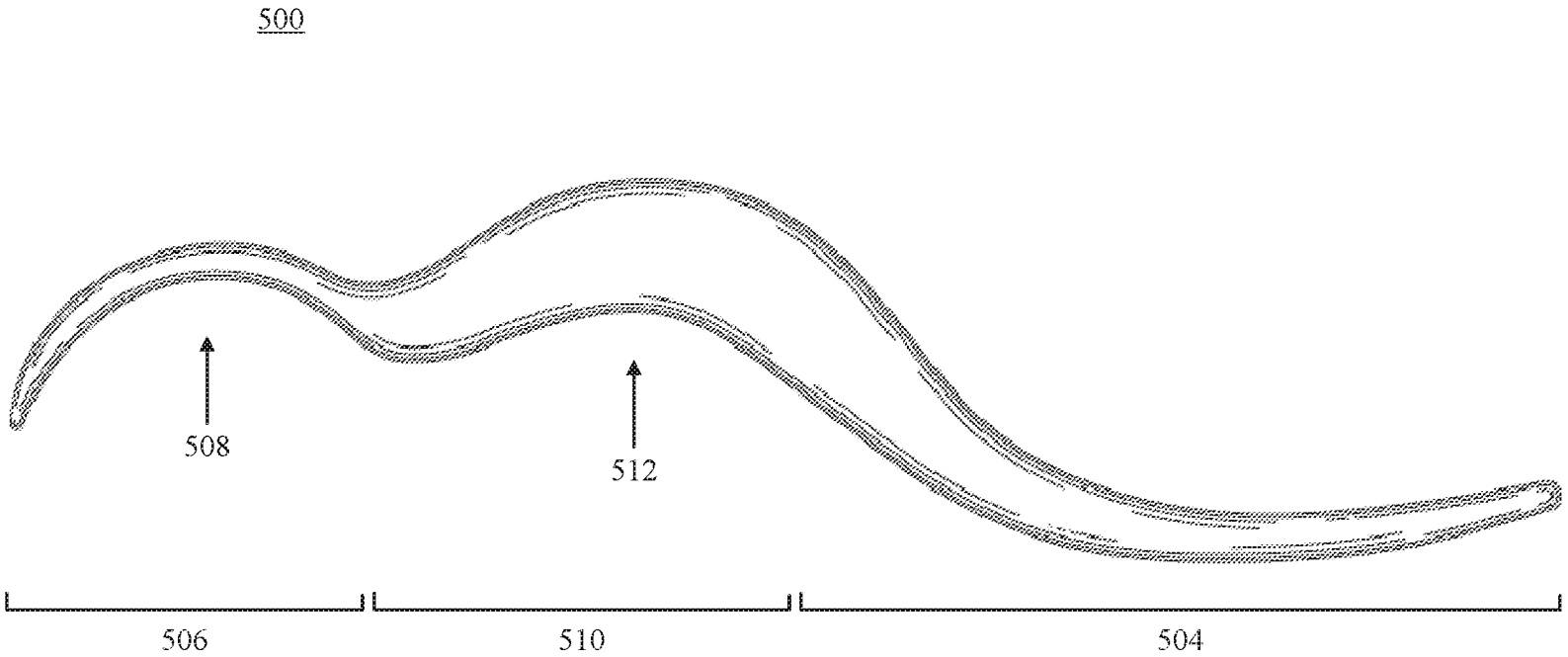

FIGS. 5A-B depict an applicator 500 that can be used to simultaneously apply an entire set of artificial lash extensions to an individual's natural lashes. FIG. 5A is a perspective view of an applicator 500 having two opposed arms, and FIG. 5B is a side view depicting the curvature of the applicator 500.

The applicator 500 includes opposed arms 502*a-b* that are connected to one another at an inner end (also referred to as a "proximal end"). Each of the opposed arms 502*a-b* can include an inner portion 504 that is gripped by an individual and an outer portion 506 that is contoured to resiliently grasp multiple lash fusions. For example, the outer portion 506 may have a concave (e.g., crescent) shape 508 that enables the applicator 500 to become substantially flush with the housing of a case (e.g., case 400 of FIGS. 4A-C) and the tightline of an eye. This non-linear shape enables the individual to readily grasp and apply an entire set of artificial lash extensions without requiring assistance from another individual (e.g., a medical professional or cosmetician).

In some embodiments, the middle portion 510 (also referred to as the "bridge) of the applicator 500 includes another concave shape 512 (also referred to as a "hump") that allows the applicator 500 to rest on the individual's cheek bone, nose bridge, etc. For example, if the individual is holding the applicator 500 in their right hand, then the individual can readily apply a set of artificial lash extensions to the right eye. However, when the individual attempts to apply a set of artificial lash extensions to the left eye, the individual may to balance the hump 512 on the bridge of the nose for stabilization. During the application process, the individual may grasp the inner portion 504 and/or the middle portion 510.

The applicator 500 can be composed of metal, plastic, or any other suitable material. Metal alloys (e.g., stainless steel) are typically preferred because they provide greater durability and allow the applicator 500 to have high precision. The term "precision" refers to the size of objects that can be grasped by the applicator 500. Highly precise grasping tools (e.g., tweezers) can grab very small objects. In order to have high precision, the opposed arms 502*a-b* must be precisely aligned and balanced so that an individual can grasp individual artificial lashes.

Figure 6A:
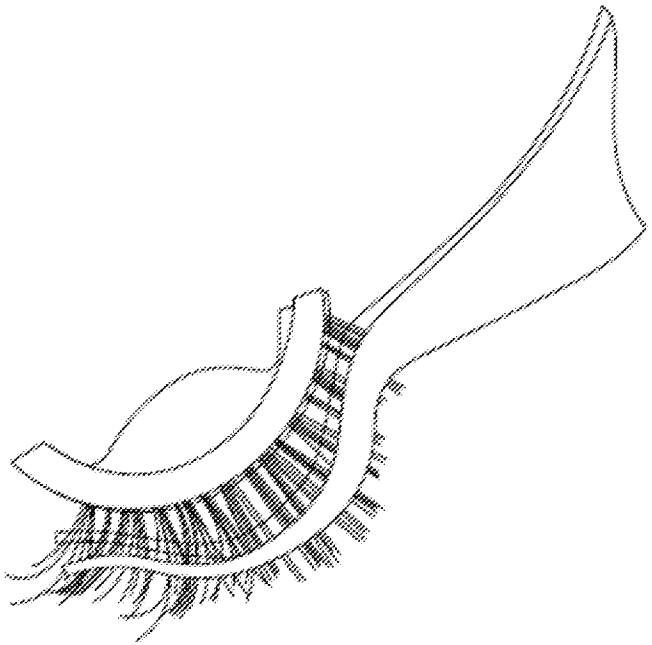
FIGS. 6A-B depict how the concave shape of the outer portions of an applicator enables an individual to simultaneously grasp all of the lash fusions in a set of artificial lash extensions.

The outer portions 506 of the opposed arms 502*a-b* are arranged to engage one another when the inner portions 504 of the opposed arms 502*a-b* are pressed toward one another by an individual. Such action causes pressure to be applied to the exterior surface of the inner portions 504 and/or the middle portions 510 of the opposed arms 502*a-b*. FIG. 6A depicts how the arrangement of a set of artificial lash extensions enables all of the lash fusions to be simultaneously grasped by an applicator. More specifically, an individual or a healthcare professional, such as a lash technician or cosmetician, can grasp an entire set of artificial lash extensions using the applicator, and then simultaneously apply the entire set of artificial lash extensions to the individual's natural lashes in a single motion.

Figure 6B:
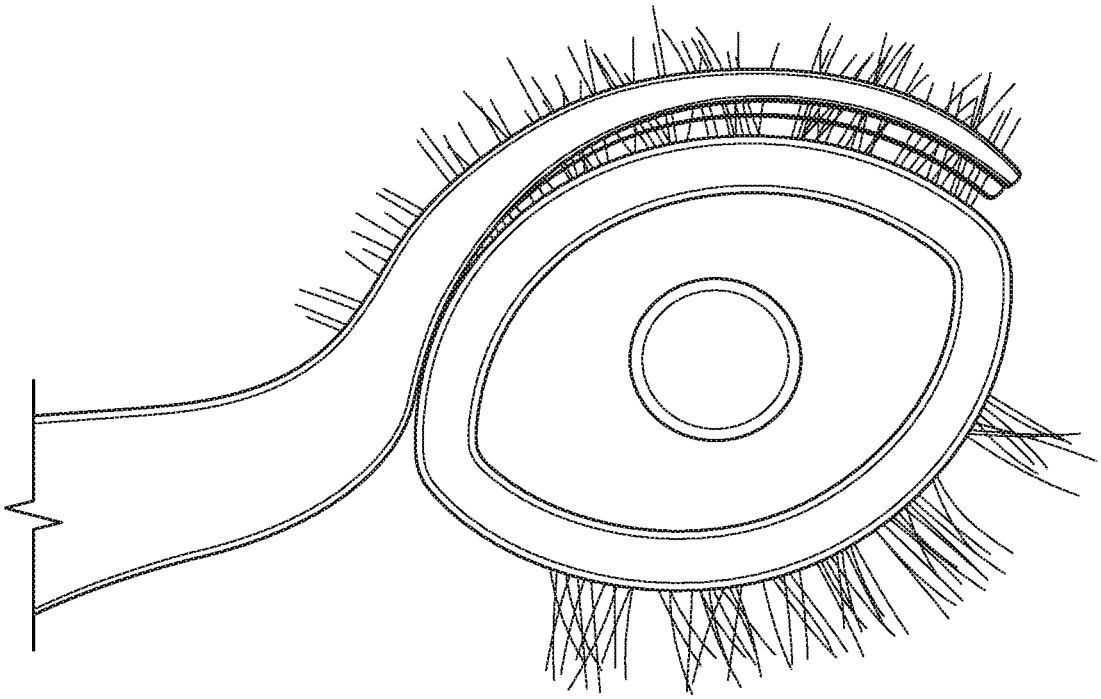

FIG. 6B depicts how the concave shape of an applicator can substantially complement the convex shape of a case. The concave shape of the applicator enables an individual to simultaneously grasp all of the lash fusions in a set of artificial lash extensions housed within the case. After grasping the set of artificial lash extensions, the individual can apply the entire set of artificial lash extensions to the natural lashes in a single motion.

The individual may also exploit the concave shape of the applicator to apply pressure to the multiple lash fusions to ensure that each lash fusion is securely attached to the natural lashes. For example, after applying the set of artificial lash extensions to the underside of the natural lashes, the individual can apply pressure another time to clamp down on the natural lashes and the artificial lash extensions. While the second application of pressure may not be necessarily, the individual may perform such action to ensure adherence of the lash fusions to the natural lashes.

In some embodiments, one or both of the opposed arms include a knurl at the outer end that can be used to aid in grasping. However, the knurl(s) must be offset from one another so that the outer portions of the opposed arms can be pressed against one another. Embodiments may also include a ridge that extends around some or all of the periphery of each opposed arm.

Although the term "individual" is generally used to refer to a person who applies sets of lash extensions to herself, those skilled in the art will recognize the technology described herein can also be used by healthcare professionals, cosmeticians, etc.

Figure 7:
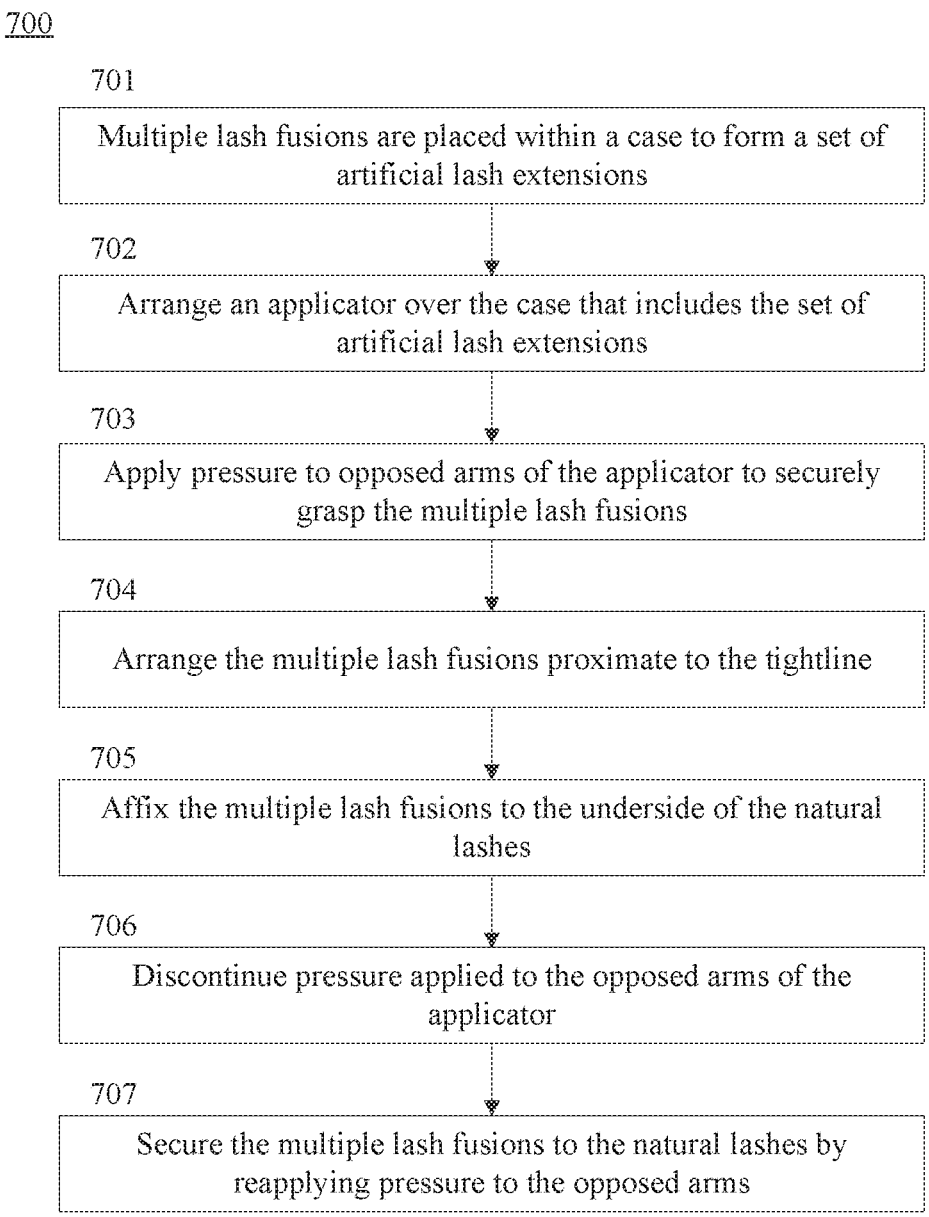
FIG. 7 depicts a flow diagram of a process for applying multiple lash fusions included in a set of artificial lash extensions.

FIG. 7 depicts a flow diagram of a process 700 for applying a set of artificial lash extensions to an individual's natural lashes. Multiple lash fusions are initially placed within a case to form a set of artificial lash extensions (step 701). As noted above, the multiple fusions may be positioned in a specific arrangement. For example, the case may include predefined indentations that cause the multiple lash fusions to be arranged in a convex pattern similar to the shape of an eyelid.

The individual can then arrange an applicator over the case that includes the set of artificial lash extensions (step 702). The applicator includes opposed arms having concave outer portions that substantially complement the convex pattern of lash fusions included in the set, as well as the convex outer surface of the case. The individual can then apply pressure to the opposed arms of the applicator to securely grasp the multiple lash fusions (step 703). Application of such pressure causes the outer portions of the opposed arms to engage one another and grasp each lash fusion included in the set.

The individual arranges the multiple lash fusions proximate to the tightline (step 704), and then attaches the multiple lash fusions to the natural lashes (step 705) by pressing the multiple lash fusions upward against the bottom of the natural eyelashes. Thus, the set of lash fusions may become substantially flush with the lash line. The initial application process can then be completed by discontinuing the pressure applied to the opposed arms of the applicator (step 706). In some embodiments, the individual may further secure the multiple lash fusions to the natural lashes by once again applying pressure to the opposed arms of the application (step 707), which causes the outer portions of the opposed arms to clamp down on the multiple lash fusions and the natural lashes.

Unless contrary to physical possibility, it is envisioned that the steps described above may be performed in various sequences and combinations. For instance, the case may already include the multiple lash fusions before coming into the possession of the individual (thus rendering step 701 unnecessary in some embodiments).

Other steps could also be included in some embodiments. For example, an adhesive may be applied to the top of each lash fusion in the set of artificial lash extensions. In other embodiments, ad adhesive is applied to the top of each lash fusion in the set of artificial lash extensions during the manufacturing process. The adhesive could be a waterproof glue or mascara. For example, the adhesive may include an oil-soluble polymer that helps to enhance adhesion and substantivity of the artificial lash extensions to the individual's natural lashes. The adhesive may be a waterproof formulation that allows the set of artificial lash extensions to remain affixed to the individual's natural lashes for longer periods of time.

Although latex-based adhesives are generally avoided to avoid irritation of the individual's eyelid (e.g., due to an allergic reaction), adhesives can include various other natural ingredients (e.g., sugar or honey) and/or chemical ingredients. For example, copolymer is often a main ingredient in many adhesive formulations. The adhesive could be a commercially-available adhesive for conventional lash extensions or a specialized composition for use with the set of lash extensions described herein. The adhesive could be clear or colored (e.g., milky white or black to emulate mascara).

Figure 8:
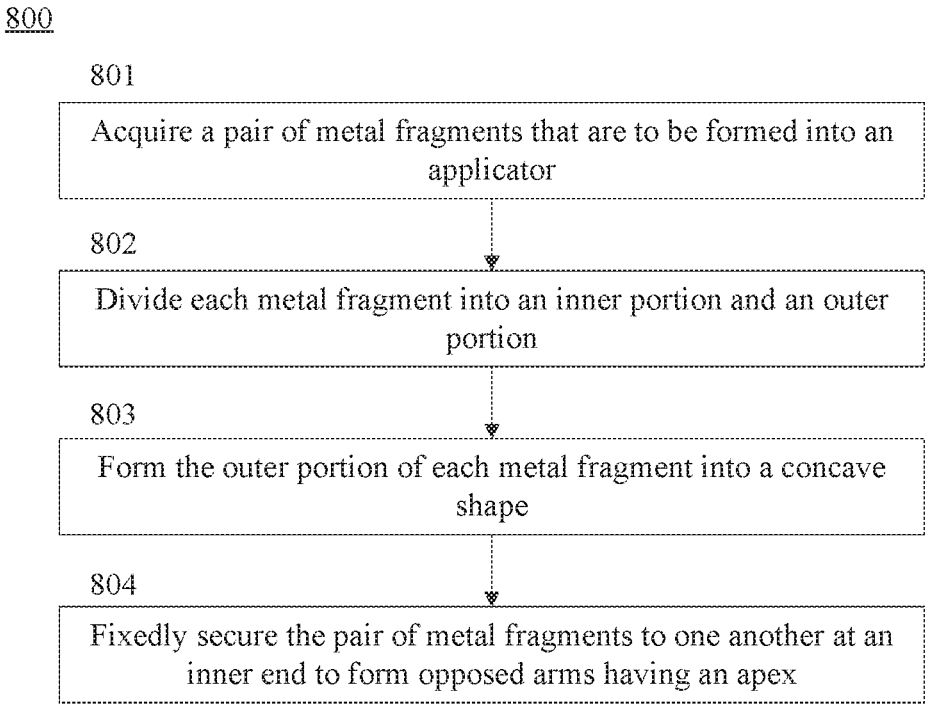
FIG. 8 depicts a flow diagram for a process for manufacturing applicators for applying artificial lash extensions.

FIG. 8 depicts a flow diagram for a process 800 for manufacturing applicators for applying artificial lash extensions. A pair of metal fragments are initially acquired that are to be formed into an applicator for applying artificial lash extensions (step 801). Generally, the metal fragments is comprised of a metal for improved durability, cleanability, etc. Examples of metals include titanium, hardened steel, stainless steel, etc.

Other materials may also be used to form the applicator. For example, the pair of fragments may be comprised of plastic, glass, foam, etc. Moreover, the applicator may be formed from a single piece of material rather than a pair of separate fragments. In such embodiments, the single piece of material can be formed into a v-shaped body having opposed arms and an apex (e.g., through the application of heat to a central point at which the single piece of material is folded).

Each metal fragment can be logically divided into an inner portion designed to be gripped by an individual and an outer portion designed to grasp a set of artificial lash extensions (step 802). For example, the outer portion of each metal fragment may be wide enough to simultaneously grasp 4-8 clusters of artificial lashes. In some embodiments, the metal fragments may be slightly thinner at the proximal end (also referred to as the "gripping end") in order to provide greater flexibility.

The outer portion of each metal fragment is then formed into a concave shape that may substantially match the tightline curvature of an eyelid (step 803). Said another way, the outer portion of each metal fragment may be contoured to match the curvature of the tightline of an eyelid. This can be accomplished, for example, using appropriately shaped die blocks and machine molding. Such a design enables an individual to simultaneously grasp and apply multiple lash fusions without requiring assistance from another individual (e.g., a medical professional or cosmetician).

In some embodiments, a middle portion of each metal fragment is also formed into a concave shape that allows the applicator to rest on the cheek bone, nose bridge, etc. For example, if an individual is holding the applicator in their right hand, then the individual can readily apply a set of artificial lash extensions to the right eye. However, when the individual attempts to apply a set of artificial lash extensions to the left eye, the individual may to balance the middle portion on the bridge of the nose for stabilization.

The pair of metal fragments can then be fixedly secured to one another at the proximal end to form opposed arms having an apex (step 804). For example, an individual may use an induction welder to fuse the pair of metal fragments together at the proximal end. This arrangement of the opposed arms allows an individual to securely grasp lash fusion(s) by applying pressure to the opposed arms. Forming the applicator in such a manner also ensures that the opposed arms naturally revert or "spring" back to their original position when pressure is no longer being applied by the individual.

In some embodiments, the applicator is treated (e.g., by being powder coated) to improve durability, resistance to scratching, cleanability, resistance to chemicals/solutions, etc. For example, the outer portion of each metal fragment may have a non-stick to avoid stickiness. Examples of non-stick coatings include polytetrafluoroethylene (PTFE) coatings, silicone coatings, etc. Upon being completed, the applicator can be used by an individual to simultaneously grasp and apply a set of artificial lash extensions by applying pressure to the opposed arms.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

What is claimed is:

1. A method for attaching artificial lash extensions to the natural lashes of a subject, the method comprising:

grasping an applicator having opposed first and second arms joined at proximal ends thereof, the first and second arms each defining:

an exterior surface, an interior surface and opposing first and second lateral sides disposed between the interior and exterior surfaces, wherein the interior surfaces of the first and second arms face each other and the arms are biased toward an open configuration in which the arms are spaced apart, each of the first and second arms having a handle portion extending from the proximal end outward to a distal end of the handle;

and an applying portion extending outwardly from the distal end of the handle portion, the handle portion defining a first longitudinal axis and a convex arc such that the first lateral side of each arm is convex and the second lateral side of each arms is concave in the handle portion, and the applying portion defines a second longitudinal axis and each provide two crescent shaped portions extending in series from the respective handle portion such that the first lateral sides of each arm provide a pair of concavities facing away from the respective second lateral side and the second lateral side of each arm provides two convexities extending in series opposite the concavities, wherein the longitudinal axis of the applying portions is arranged offset from the longitudinal axis of the handle portion such that the concavities of the first and second arms face the longitudinal axis of the handle portion;

applying pressure to the exterior surfaces of the first and second arms of the applicator to securely grasp a set of lash extensions that includes multiple lash fusions between the interior surfaces of a distal-most one of the two crescent shaped portions, wherein the application of the pressure causes the interior surfaces of the first and second arms at the distal-most one of the two crescent shaped portions to engage one another, thereby grasping the multiple lash fusions simultaneously, arranging the set of lash extensions proximate to a tightline of an eyelid of the subject via the opposing arms;

attaching the set of lash extensions to an underside of the natural lashes of the subject; and discontinuing to apply pressure to the opposed arms of the applicator.

2. The method of claim 1, further comprising:

applying an adhesive to a top side of each lash fusion included in the set of lash extensions prior to performing said attaching.

3. The method of claim 2, wherein the adhesive comprises cyanoacrylate.

4. The method of claim 1, wherein said attaching is enabled by an adhesive coating applied to a top side of each lash fusion included in the set of lash extensions during a manufacturing process.

5. The method of claim 1, further comprising:

securing the multiple lash fusions to the underside of the natural lashes of the subject by initiating a second application of pressure to the opposed arms of the applicator, wherein the second application of pressure causes the outer portions of the opposed arms to clamp down on the multiple lash fusions and the natural lashes of the subject.

6. The method of claim 1, further comprising:

arranging the applicator over a case that includes the set of lash extensions, wherein the case includes multiple predefined indentations for receiving a lash fusion, and wherein the case includes a convex outer surface on which the multiple lash fusions are arranged, the convex outer surface substantially complementing the crescent shape of the outer portions of the opposed arms.

7. The method of claim 1, further comprising:

applying an adhesive to a top side of each lash fusion that allows the set of lash extensions to be applied to an underside of the natural lashes of the subject without requiring manual application of an adhesive to the natural lashes.

* * * * *